US005299851A

United States Patent [19]

Lin

[11] Patent Number: 5,299,851

[45] Date of Patent: Apr. 5, 1994

[54] ADJUSTABLE CUSHION ASSEMBLY FOR A CHAIR

[76] Inventor: Kuen-Yuan Lin, No. 4, Sec. 3, Tan-Hsing Rd., Tan-Tzu Hsiang, Taichung Hsien, Taiwan

[21] Appl. No.: 67,045

[22] Filed: May 19, 1993

[51] Int. Cl.[5] ..... A47C 7/46

[52] U.S. Cl. ..... 297/284.5; 297/284.4

[58] Field of Search ..... 297/284.4, 284.5, 230.14

[56] References Cited

U.S. PATENT DOCUMENTS

| | | | |
|---|---|---|---|
| 3,724,144 | 4/1973 | Schuster | 297/284.4 X |
| 4,316,631 | 2/1982 | Lenz et al. | 297/284.4 |
| 4,354,709 | 10/1982 | Schuster | 297/284.4 X |
| 4,632,454 | 12/1986 | Naert | 297/284.4 |
| 5,088,790 | 2/1992 | Wainwright et al. | 297/284.4 |

*Primary Examiner*—Peter R. Brown

*Attorney, Agent, or Firm*—Ostrolenk, Faber, Gerb & Soffen

[57] ABSTRACT

An adjustable cushion assembly includes a cushion, a covering enclosing the cushion, an upright flexible metal plate disposed behind the cushion, and an adjustment device. The metal plate has several pairs of aligned horizontal notches that are formed in two opposite side portions thereof. The adjustment device includes a generally vertical flexible pull rod abutting against the metal plate and having an upper end portion secured to the metal plate. A threaded horizontal rod is journalled on a lower end portion of the metal plate, A movable nut member engages threadably the horizontal rod. An inclined first connecting rod has a lower end connected pivotally to the nut and an upper end connected pivotally to the lower end of the pull rod. An inclined second connecting rod has a lower end mounted pivotally on the metal plate and an upper end mounted pivotally on the lower end of the pull rod. Accordingly, when the horizontal rod is rotated, the nut member moves on the horizontal rod so as to increase an angle between the first and second connecting rods, thereby moving the pull rod downward. The downward movement of the pull rod flexes the metal plate and the cushion.

5 Claims, 7 Drawing Sheets

ADJUSTABLE CUSHION ASSEMBLY FOR A CHAIR

BACKGROUND OF THE INVENTION

1. Field of the Invention

The invention relates to an adjustable cushion assembly for a chair, more particularly to an adjustable cushion assembly which has a curvature that can be adjusted to suit the needs of the user.

2. Description of the Related Art

Referring to FIGS. 1 and 2, a conventional cushion (1') is placed on a chair (2'). In general, the cushion (1') is of a fixed shape and cannot be adjusted to suit the figure of the user when he/she sits on the chair (2'). The cushion (1') can provide momentary comfort and not long-term comfort to the user. Thus, the cushion (1') is not favoured by many people.

SUMMARY OF THE INVENTION

The main object of this invention is to provide an adjustable cushion assembly which includes an upright flexible metal plate and an adjustment device that are disposed behind a cushion so as to adjust the curvature of the adjustable cushion assembly to suit the figure of the user.

According to this invention, an adjustable cushion assembly includes a cushion, a covering, an upright flexible metal plate, and an adjustment device. The cushion is adapted to be placed on the chair. The covering encloses the cushion therein. The upright flexible metal plate is disposed on the covering and is located behind the cushion. Several pairs of horizontal notches are formed in the periphery of the metal plate. The notches of each pair are aligned with each other and are formed in two opposite side portions of the metal plate. The adjustment device includes a generally vertical flexible pull rod which abuts against the metal plate and which has an upper end portion secured to the metal plate. A threaded horizontal rod is journalled on the lower end portion of the metal plate. A movable nut member is engaged threadably with the horizontal rod. An inclined first connecting rod has a lower end connected pivotally to the nut member and has an upper end connected pivotally to the lower end of the pull rod. An inclined second connecting rod has a lower end mounted pivotally on the metal plate and has an upper end mounted pivotally on the lower end of the pull rod.

When the horizontal rod is rotated, the nut member moves on the horizontal rod so as to increase the angle between the first and second connecting rods, thereby moving the pull rod downward. The downward movement of the pull rod flexes the metal plate and the cushion.

BRIEF DESCRIPTION OF THE DRAWING

Other features and advantages of this invention will become apparent in the following detailed description of a preferred embodiment of this invention, with reference to the accompanying drawings, in which:

FIG. 8 is a schematic view illustrating an application of the adjustable cushion assembly according to this invention.

DETAIL DESCRIPTION OF THE PREFERRED EMBODIMENT

Figure 1:
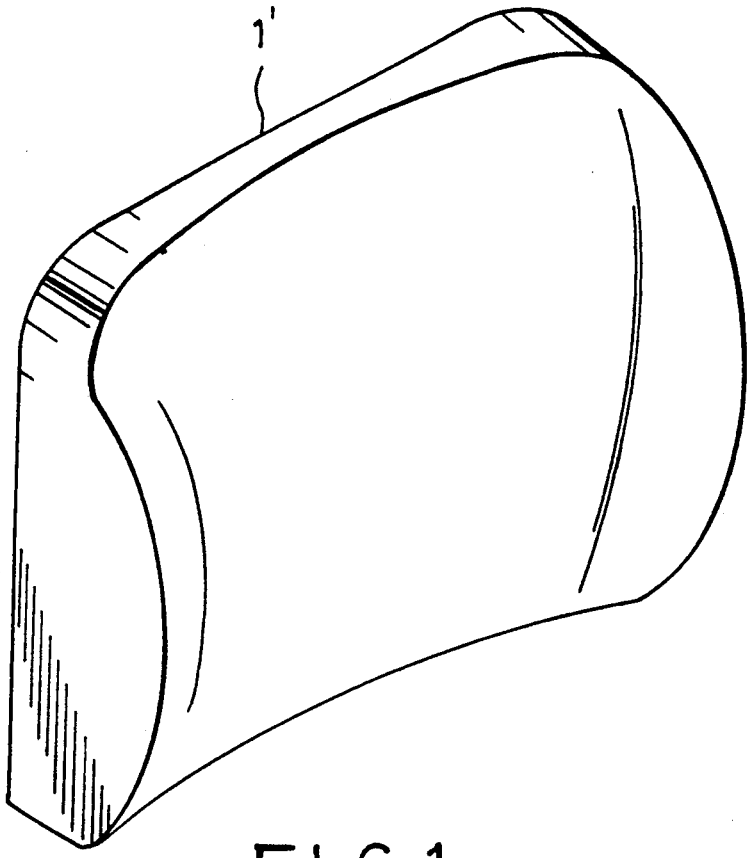
FIG 1 PRIOR ART
FIG. 1 is a perspective view of a conventional cushion.
Figure 2:
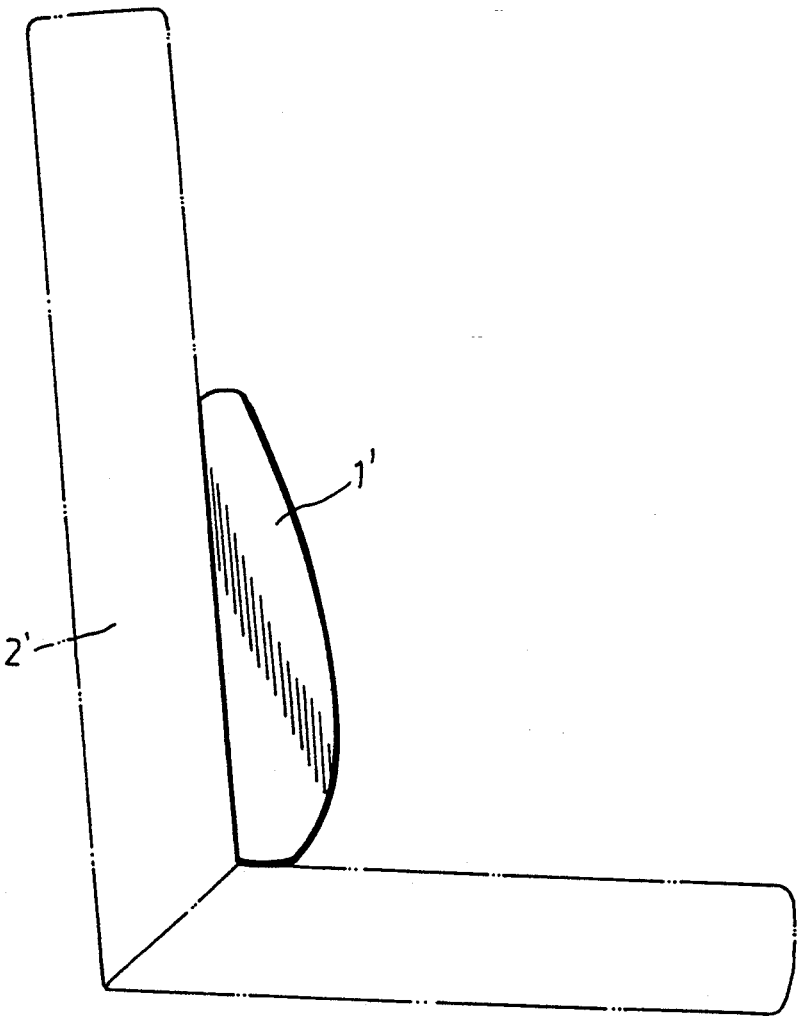
FIG.2 PRIOR ART
FIG. 2 is an elevational view showing the cushion when placed on a chair.

Referring to FIG. 8, the adjustable cushion assembly of this invention includes a cushion (1), a covering (2), an upright flexible metal plate (10), and an adjustment device (20). The cushion (1) is placed on a chair (3) (indicated by phantom lines). The covering (2) encloses the cushion (1) therein. The upright flexible metal plate (10) is disposed on the covering (2) and behind the cushion (1).

Figure 3:
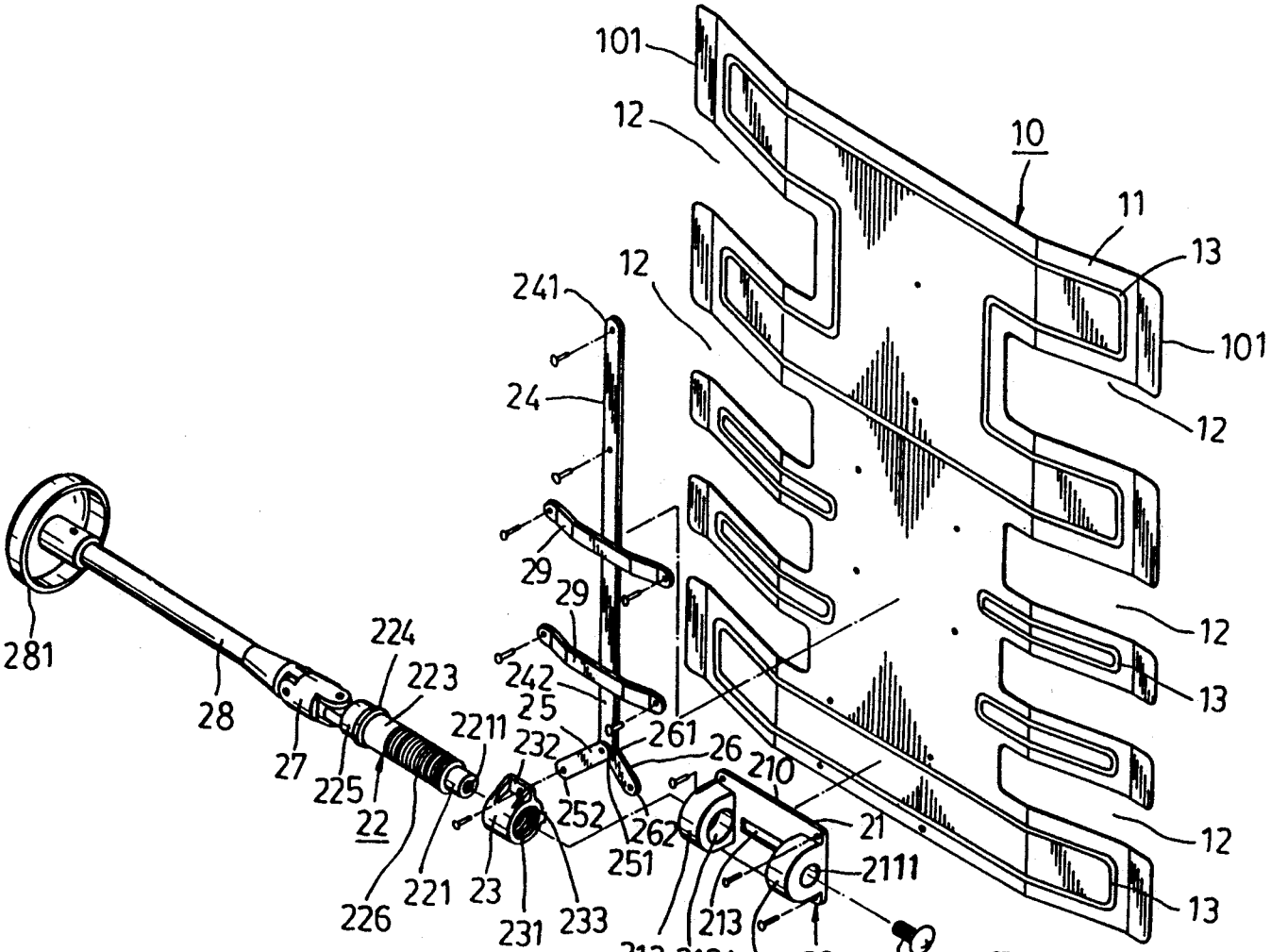
FIG. 3 is an exploded view showing the upright flexible metal plate and the adjustment device of an adjustable cushion assembly according to this invention.
Figure 4:
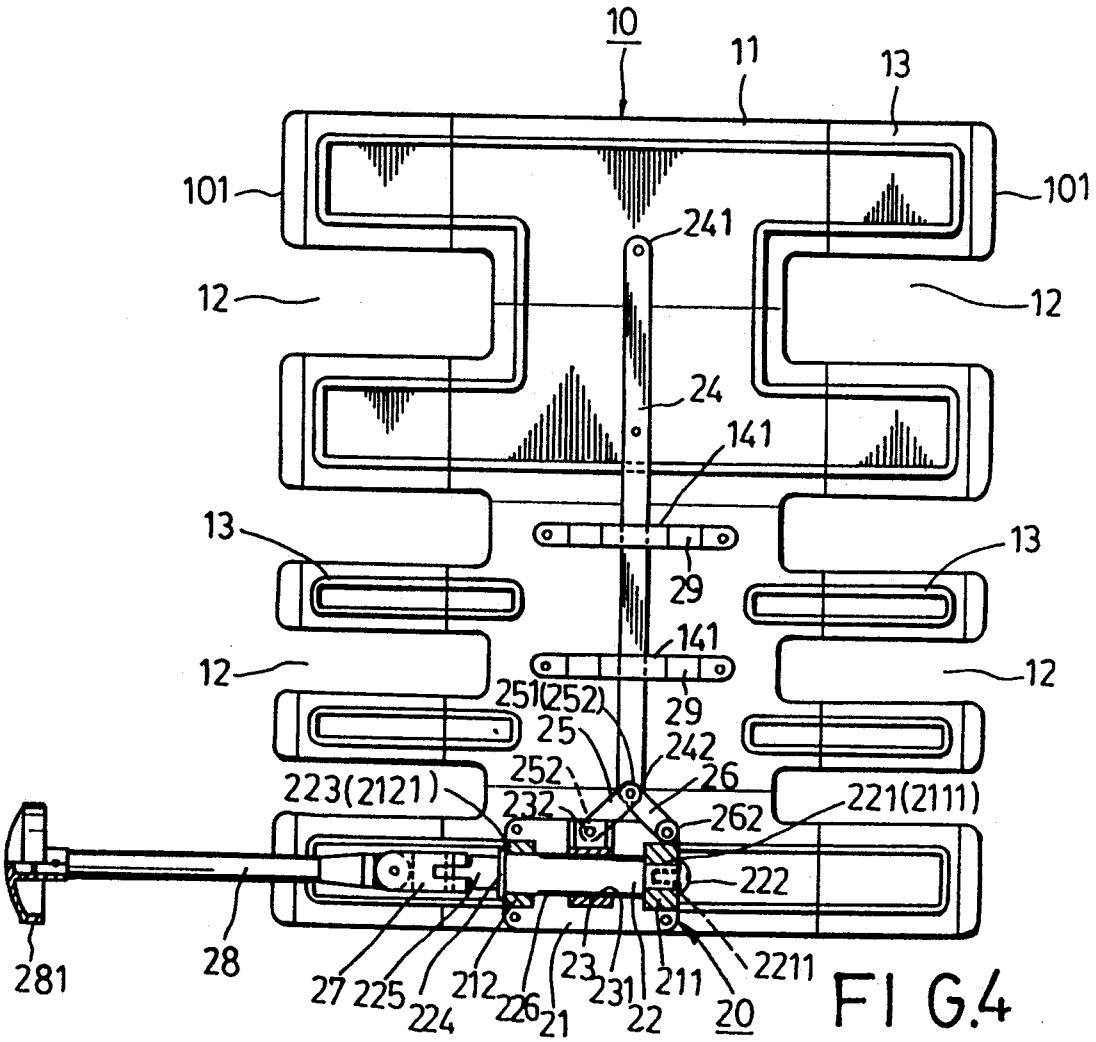
FIG. 4 is an elevational rear view showing the connection of the upright flexible metal plate and the adjustment device of this invention.

Referring to FIGS. 3 and 4, the upright flexible metal plate (10) has four pairs of horizontal notches (12) formed in the periphery thereof and six endless reinforcing ribs (13) disposed on the metal plate (10). Majority of the reinforcing ribs (13) are located in the peripheral portion of the metal plate (10). The notches (12) of each pair are aligned with each other and are formed in two opposite side portions (101) of the metal plate (10).

The adjustment device (20) includes a bearing unit (21), a threaded horizontal rod (22), a movable nut member (23), a generally vertical flexible pull rod (24), an inclined first connecting rod (25), an inclined second connecting rod (25), a universal joint (27), and a horizontal operation rod (28).

Figure 5:
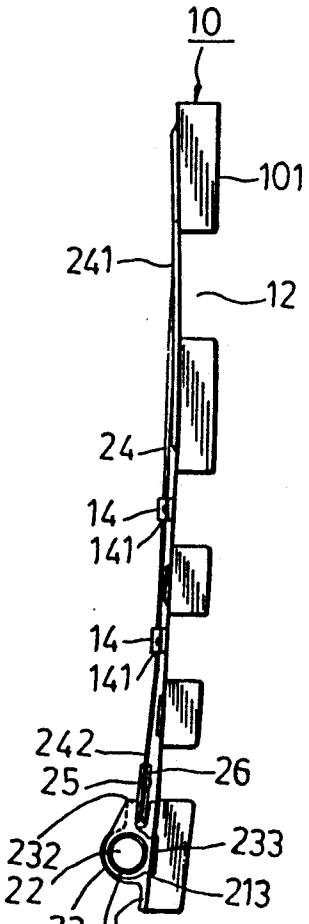
FIG. 5 is an elevational side view of the metal plate and the adjustment device of this invention.

The pull rod (24) abuts against the metal plate (10) and has an upper end portion (241) connected securely to the metal plate (10). The adjustment device (20) further includes two horizontal confining strips (29), each of which has two ends fastened to the metal plate (10). Each of the strips (29) is disposed around an intermediate portion of the pull rod (24) in such a manner that a clearance (141) (see FIG. 5) is formed therebetween. Accordingly, the intermediate portions of the pull rod (24) can effect a short-distance horizontal movement.

The bearing unit (21) includes a vertical connecting plate (210) mounted securely on a lower end portion of the metal plate (10). The connecting plate (210) has a first lug (212) with a large positioning hole (2121) formed therethrough, a second lug (211) with a small positioning hole formed therethrough, and a horizontal guide slot (213) formed through the connecting plate (210). The first lug (212) and the second lug (211) are positioned in two opposite sides of the connecting plate (210).

The threaded horizontal rod (22) includes a reduced-diameter end portion (221) with an axial threaded hole (2211) formed in the end surface thereof, a flange (224) projecting outward from the other end portion (223) of the horizontal rod (22), and a threaded portion (226) located between the flange (224) and the reduced-diameter end portion (221). The reduced-diameter end portion (221) is journalled within the small positioning hole (2111) of the second lug (211) and is positioned in the second lug (211) by means of a bolt (222) which engages threadably the threaded hole (2211) of the reduced-diameter end portion (221). The end portion (223) of the horizontal rod (22) is journalled within the large positioning hole (2121) of the first lug (212) in such a manner that the flange (224) abuts against the side wall of the first lug (212). Accordingly, the horizontal rod (22) is confined between the first and second lugs (212, 211) of the bearing unit (21). The horizontal rod (22) further includes a pivot end (225) connected securely to the flange (224).

The universal joint (27) interconnects the pivot end (225) of the horizontal rod (22) and an end of the operation rod (28). The operation rod (28) has a rotary knob element (281) mounted securely on the other end of the operation rod (28). The operation rod (28) can be rotated relative to the horizontal rod (22) so as to form a right angle therebetween, thereby enabling the operation rod (28) to rotate about the horizontal rod (22). Accordingly, the horizontal rod (22) can be easily rotated.

The movable nut member (23) has a nut body with a threaded hole (231) that is engaged threadably with the horizontal rod (22), a connecting tongue (232) that protrudes from the top end of the nut body, and a guide pin (233) that is secured to the nut body and that is engaged in the guide slot (213) so as to prevent the nut member (23) from rotating relative to the metal plate (10).

The first connecting rod (25) has a lower end (252) that is mounted pivotally to the connecting tongue (232) of the nut member (23), and an upper end (251) that is connected pivotally to the lower end (242) of the pull rod (24).

The second connecting rod (26) has a lower end (262) that is mounted pivotally on the metal plate (10), and an upper end (261) that is connected pivotally to the lower end (242) of the pull rod (24).

Figure 7:
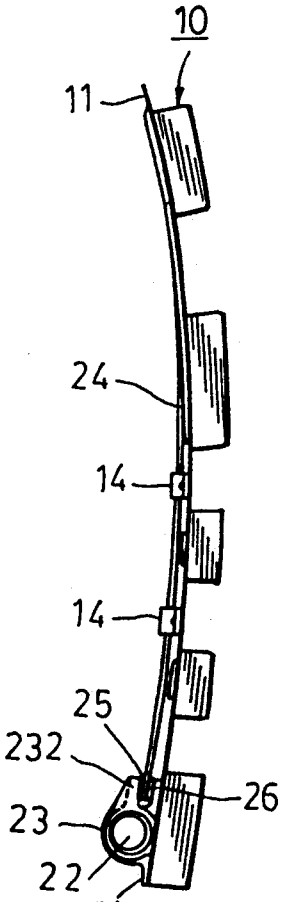
FIG. 7 is a schematic view illustrating the curvature of the metal plate of this invention when the adjustment device is operated.
Figure 6:
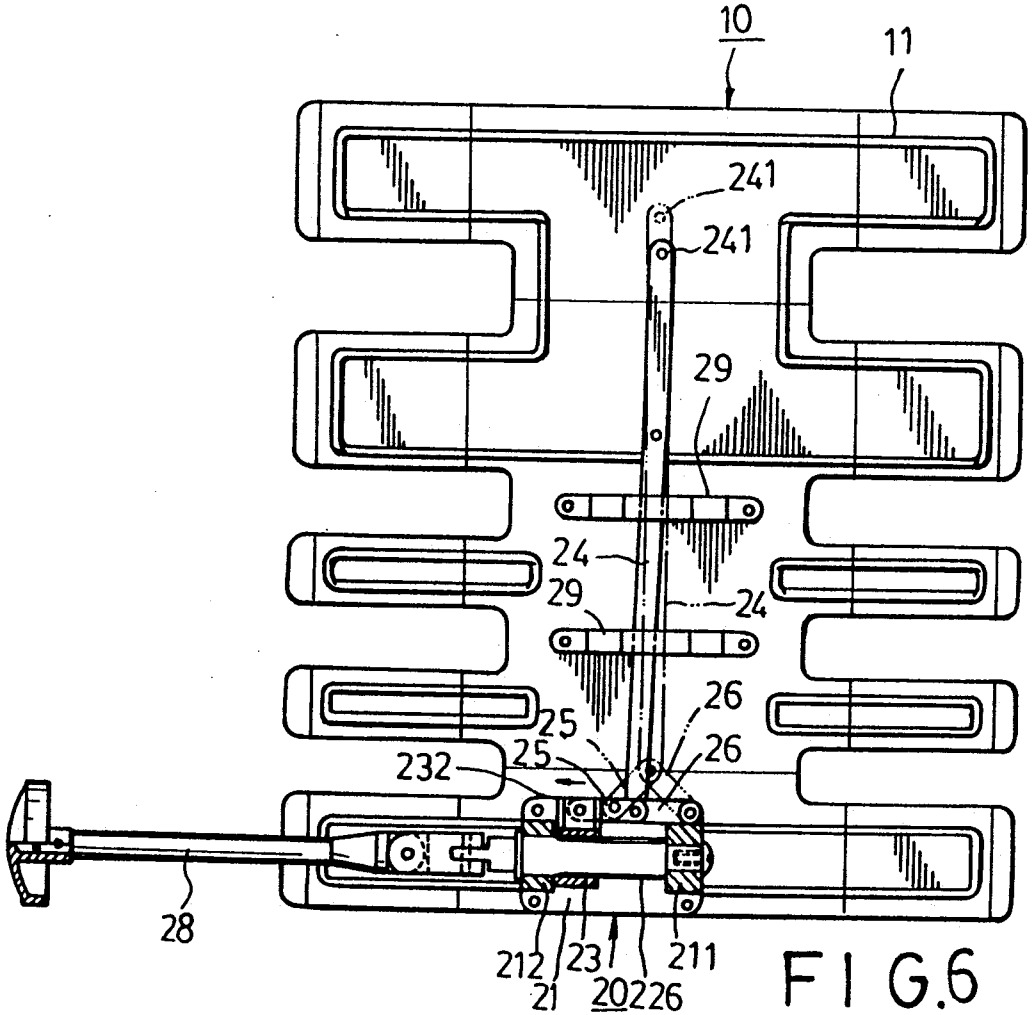
FIG. 6 is a schematic view illustrating the operation of the adjustment device of the adjustable cushion assembly according to this invention.
Figure 11:
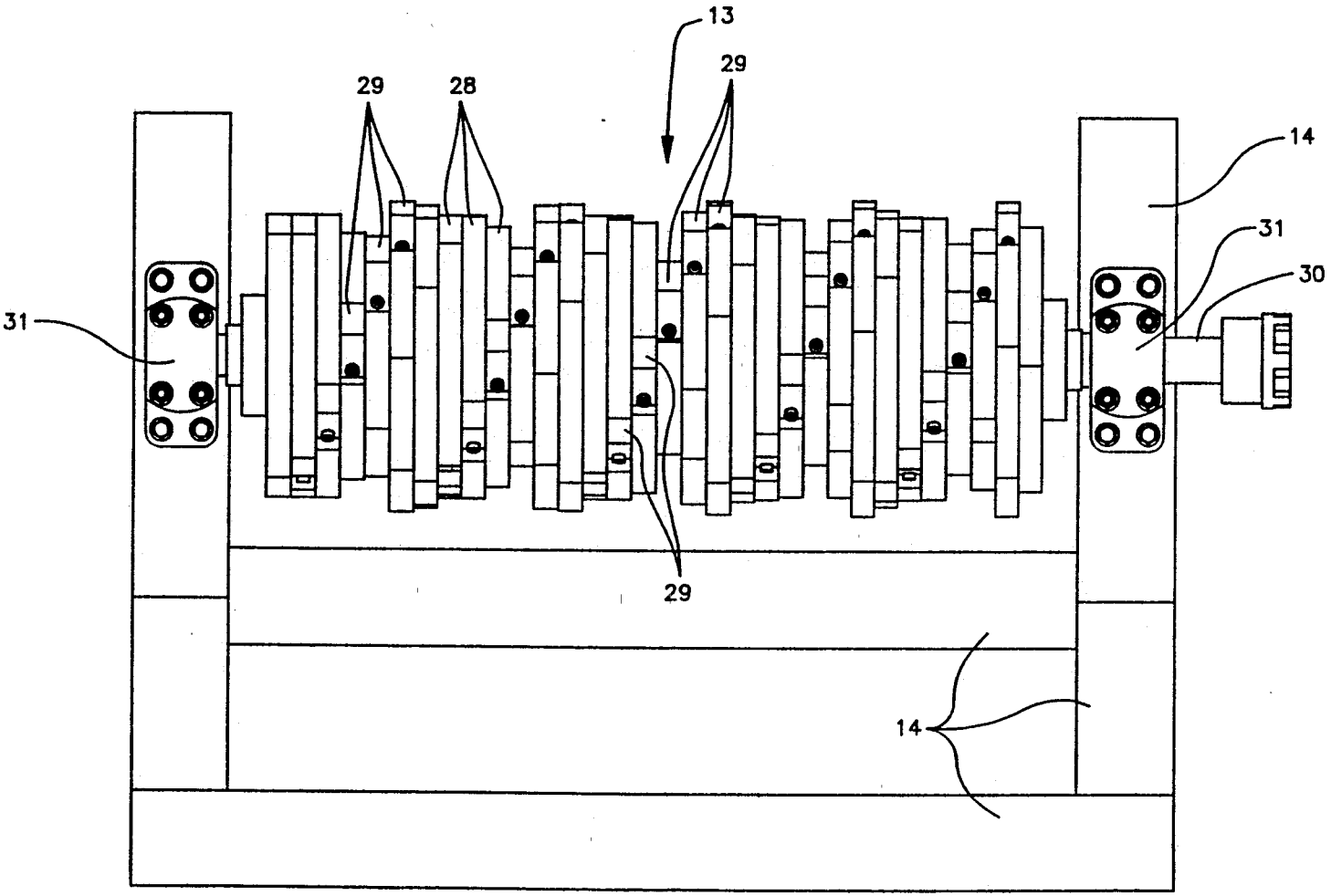

Referring to FIGS. 6 and 7, when the rotary knob element (281) is rotated so as to rotate the horizontal rod (22), the nut (23) moves on the horizontal rod (22) so as to increase the angle between the first and second connecting rods (26, 25), thereby moving the pull rod (24) downward. The downward movement of the pull rod (24) flexes the metal plate (10) and the cushion (1) (see FIGS. 8 or 9).

Figure 9:
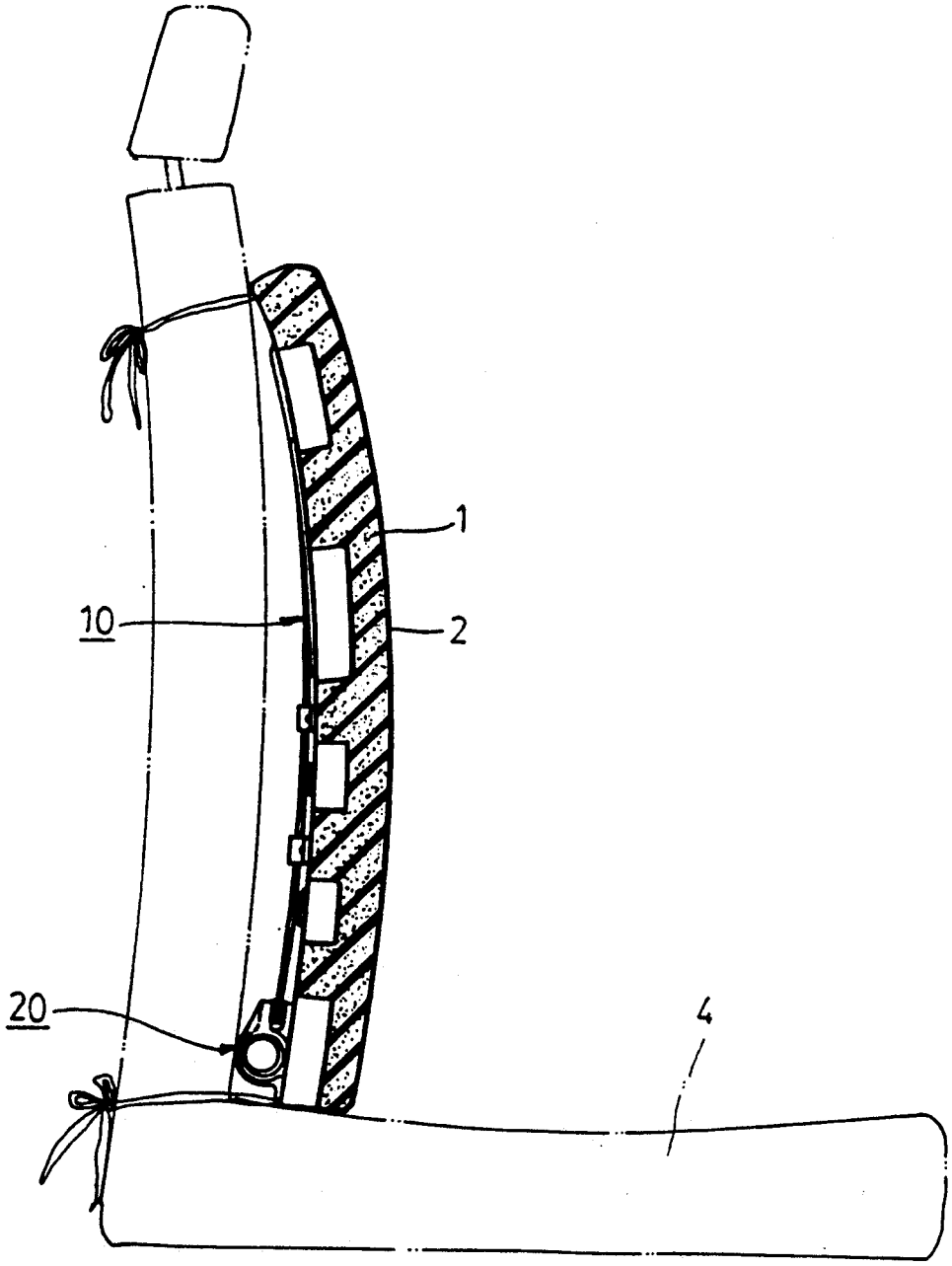
FIG. 9 is a schematic view illustrating another application of the adjustable cushion assembly in accordance with this invention.

Referring to FIG. 9, the adjustable cushion assembly of this invention may be installed on a driver seat (4) (indicated by phantom lines) of a car (not show).

With this invention thus explained, it is apparent that numerous modifications and variations can be made without departing from the scope and spirit of this invention. It is therefore intended that this invention be limited only as indicated in the appended claims.

I claim:

1. An adjustable cushion assembly for a chair, comprising:

a cushion adapted to be placed on the chair;

a covering enclosing said cushion therein;

an upright flexible metal plate disposed on said covering and located behind said cushion, said metal plate having several pairs of horizontal notches formed in a periphery thereof, said notches of each of said pairs being aligned with each other and being formed in two opposite side portions of said metal plate; and an adjustment device including:

a generally vertical flexible pull rod abutting against said metal plate and having an upper end portion secured to said metal plate, a bearing unit, a threaded horizontal rod journalled on a lower end portion of said metal plate by means of said bearing unit, a movable nut engaged threadably with said horizontal rod, an inclined first connecting rod having a lower end connected pivotally to said nut, and an upper end connected pivotally to the lower end of said pull rod, and an inclined second connecting rod having a lower end mounted pivotally on said metal plate and an upper end mounted pivotally on a lower end of said pull rod, whereby, when said horizontal rod is rotated, said nut moves on said horizontal rod so as to increase an angle between said first and second connecting rods, thereby moving said pull rod downward, downward movement of said pull rod flexing said metal plate and said cushion.

2. An adjustable cushion assembly as claimed in claim 1, wherein said metal plate includes a plurality of reinforcing ribs disposed on a peripheral portion thereof.

3. An adjustable cushion assembly as claimed in claim 1, wherein said adjustment device includes a horizontal operation rod, a universal joint interconnecting an end of said horizontal rod and an end of said operation rod, and a rotary knob element mounted securely on an opposite end of said operation rod, whereby, said horizontal rod can be easily rotated.

4. An adjustable cushion assembly as claimed in claim 1, wherein said adjustment device includes two horizontal confining strips, each of which having two ends fastened to the said metal plate, each of said strips being disposed around an intermediate portion of said pull rod in such a manner that a clearance is formed therebetween, whereby, the intermediate portions of said pull rod can effect a short-distance horizontal movement.

5. An adjustable cushion assembly as claimed in claim 1, wherein said bearing unit includes a vertical connecting plate mounted securely on said metal plate, said connecting plate including two lugs on which said horizontal rod is journalled, and a horizontal guide slot formed therethrough, said nut having a guide pin which is secured thereto and which engages said guide slot so as to prevent said nut from rotating relative to said metal plate.

* * * * *